US007066768B2

(12) United States Patent
Kameyama

(10) Patent No.: US 7,066,768 B2
(45) Date of Patent: Jun. 27, 2006

(54) CONNECTOR WITH ADJUSTABLE DIELECTRIC CONSTANT

(75) Inventor: Isao Kameyama, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/979,252

(22) Filed: Nov. 3, 2004

(65) Prior Publication Data

US 2005/0101166 A1 May 12, 2005

(30) Foreign Application Priority Data

Nov. 12, 2003 (JP) ..... 2003-382446

(51) Int. Cl.
*H01R 24/00* (2006.01)
*H01R 33/00* (2006.01)

(52) U.S. Cl. ..... 439/660; 439/568

(58) Field of Classification Search ..... 439/660, 439/79, 598, 599

See application file for complete search history.

(56) References Cited

U.S. PATENT DOCUMENTS 3,883,452 A * 5/1975 Scheuerlein et al. ..... 524/512
6,116,945 A * 9/2000 Davis et al. ..... 439/462
6,380,271 B1 * 4/2002 Enoki et al. ..... 521/77
6,808,417 B1 * 10/2004 Yoshida ..... 439/585

FOREIGN PATENT DOCUMENTS

JP 2003-100399 4/2003

* cited by examiner

*Primary Examiner*—Hae Moon Hyeon
(74) *Attorney, Agent, or Firm*—Armstrong, Kratz, Quintos, Hanson & Brooks, LLP

(57) ABSTRACT

A connector, which can have impedance matching between the connector and a cable or a mating connector even if the connector is miniaturized, and a manufacturing method thereof are provided. The connector is joined with an end of a cable 5. The connector has terminals, and a holder having an inner holder holding the terminals and an inner housing. The mating connector has terminals, and a holder holding the terminals. The holders are made of a foamed synthetic resin. Expansion ratio of the resin for the holder of the connector is adjusted to match the impedance with each wire of the cable 5. Expansion ratio of the resin for the holder of the mating connector is adjusted to match the impedance with the connector.

4 Claims, 7 Drawing Sheets

CONNECTOR WITH ADJUSTABLE DIELECTRIC CONSTANT

The priority application Number Japan Patent Application No. 2003-382446 upon which this patent application is based is hereby incorporated by reference.

BACKGROUND OF THE INVENTION

1. Field of the Invention

This invention relates to a connector which is used for connecting electrically between electronic devices installed in a vehicle, and is adjusted an impedance thereof with an electrical wire and a mating connector. This invention also relates to a method of manufacturing the connector.

2. Description of the Related Art

Various electronic devices are installed in a car as the vehicle. Therefore, in the car, a wiring harness is wired for transmitting electric power and signals. The wiring harness has a plurality of electrical wires and connectors.

The electrical wire has a conductive core wire, and a cover made of insulating synthetic resin for covering the core wire, and is called generally a covered (electrical) wire. The connector has a terminal made of electrical conductive metal, and a connector housing for receiving the terminal. The connector housing is made of insulating synthetic resin, and fits to a mating connector of the electronic device for transmitting required power supply and signals to the electronic devices.

Impedance of the connector or the mating connector of the electronic device can be adjusted to match with the fitted connector or an electrical wire joined with the terminal. When a large amount of signal is transmitted at high speed, the impedance requires adjustment.

A connector for connecting a main body of a navigation system, for example, a GPS (Global Positioning System) for calculating a present position and a display device for indicating the present position and a target position as electronic devices is required to transmit a large amount of the signal at high speed, because the display device is required to have a higher resolution and to show the present position at real time. Impedance matching becomes more necessary.

Thereby, the amount of signal transmitted from the main body to the display device is increased, and the signals are required to be transmitted at higher speed so as to show the transmitted signals at real time in the display device. There are an imbalance type (single-end type) and a parallel type (differential type) as general transmitting types.

The single-end type is to detect differences of voltages between one signal line and ground line for detecting a high state and a low state of digital signal, and is used generally.

The differential type uses two signal lines (positive and negative lines), and detects the high state and the low state by detecting the differences of voltages between the two signal lines. One of two signals transmitted through the two signal lines has a negative voltage in case, but the one signal is called a positive signal in this specification. The other of two signals transmitted through the two signal lines has a positive voltage in case, but the other signal is called a negative signal in this specification.

The two signals of the differential type transmission have the same voltage level with different phase angles shifted 180 degrees to each other. According to the differential type, noise generated in the two signal lines is canceled at inputting the signals into a receiver. Thereby, the differential type transmission can transmit signals faster than the single-end type transmission.

This applicant proposed a connector having a terminal for positive signals, a terminal for negative signals, and a ground terminal for high-speed differential type transmission, for example patent reference 1. A connector described in a patent reference 1 is joined at an end of a cable.

The cable has an electrical wire for positive signals, an electrical wire for negative signals, and an electrical wire for grounding. The electrical wire for positive signals is joined with the terminal for positive signals. The electrical wire for negative signals is joined with the terminal for negative signals. The electrical wire for grounding is joined with the terminal for grounding. In the cable, the electrical wire for positive signals, the electrical wire for negative signals, and the electrical wire for grounding are positioned in parallel. The electrical wire for positive signals, the electrical wire for negative signals, and the electrical wire for grounding are positioned to form triangularly in a section of the cable.

In the connector according to the patent reference 1, the terminal for positive signals, the terminal for negative signals, and the terminal for the ground are located triangularly similarly as locations of the wires in the cable. Thereby, the connector according to the patent reference 1 has a constant relationship of relative positions of transmission paths of each signal through the cable to the connector. Thus, impedance matching between each of the electrical wires in the cable is adjusted. The patent reference 1 is Japan Patent Application Laid open 2003-100399.

SUMMARY OF THE INVENTION

Objects to be Solved

A connector, which is used for connecting the main body and the display device of the navigation system installed in the car, is required to be smaller in a size. When miniaturizing the connector more, a distance between respective terminals becomes less.

It is known that the impedance of the connector is determined by a distance between terminals, a sectional area, and a dielectric constant of a synthetic resin of a connector housing.

In the connector, for adjusting the impedance of the connector with that of cable according to miniaturization of the size, the synthetic resin of the connector housing was changed properly. Changing different synthetic resins for respective connector housings increases a cost of the connectors. In addition, it becomes more difficult to have impedance matching by changing different synthetic resins for the connector housings according to miniaturizing more.

In the connector, the distance between terminals must correspond to the distance between terminals of the mating connector. Thereby, for impedance matching, the dielectric constant of the connector housing must be changed. However, it becomes more difficult to have impedance matching by changing different synthetic resins for the connector housings according to miniaturizing more.

To overcome the above problem, objects of this invention are to provide a connector capable of having impedance matching with the cable or the mating connector when the connector is miniaturized, and a method of manufacturing the connector. How to attain the object of the present invention In order to attain the object of the present invention, a connector according to aspect of the present invention is connected with a mating connector, and includes a plurality of terminals, and a holder holding the plurality of terminals, the holder being made of a foamed synthetic resin. A dielectric constant of the holder is adjusted by changing an expansion ratio of the foamed synthetic resin so as to have impedance matching between the connector and one of electrical wires connected with the plurality of terminals and the mating connector.

A method of manufacturing the connector, which has the plurality of terminals and the holder holding the plurality of terminals, and is connected with the mating connector, according to further aspect of the present invention includes the steps of changing an expansion ratio of a synthetic resin mixed with a foaming agent so as to adjust a dielectric constant of the synthetic resin for having impedance matching between the connector and one of electrical wires connected with the plurality of terminals and the mating connector, and forming the holder with the foamed synthetic resin.

Accordingly in the connector mentioned above, by changing the expansion ratio of the synthetic resin of the holder, the dielectric constant of the holder can be changed. Thereby, the impedance between the connector and the electrical wire or the mating connector can be adjusted by changing the expansion ratio of the synthetic resin of the holder.

Accordingly in the method of manufacturing the connector mentioned above, by changing the expansion ratio of the synthetic resin of the holder, the dielectric constant of the holder can be changed. Thereby, the impedance between the connector and the electrical wire or the mating connector can be adjusted by changing the expansion ratio of the synthetic resin of the holder, but not changing a material of the holder.

The holder is made of the synthetic resin by foam molding for holding the terminals. A conductive material, such as a metal, may cover the holder. The holder holds the terminals by receiving the terminals in sections (terminal receiving sections) located inside thereof, or molding integrally together with the terminals by insert molding, or engaging the terminals in the holder.

The expansion ratio is defined by a value of a density of the synthetic resin divided by a density of foamed synthetic resin.

Effect of the Invention

According to one aspect of the invention, by changing the expansion ratio of the synthetic resin of the holder, the impedance between the connector and the electrical wire or the mating connector can be matched. Thus, the dielectric constant of the holder can be changed easily for impedance matching even if the size is miniaturized.

The dielectric constant of the holder can be changed without change of the material, for the impedance matching between the connector and the electrical wire or the mating connector. Therefore, increasing cost by changing material can be prevented.

The above and other objects and features of this invention will become more apparent from the following description taken in conjunction with the accompanying drawings.

DESCRIPTION OF THE PREFERRED EMBODIMENT

A connector of an embodiment according to the invention will be described with reference to FIG. 1–10. A connector 1, and a mating connector 1*a* are fitted to each other for connecting a main body 3 and display devices 4 of a navigation system 2 as electronic devices installed in a vehicle shown in FIG. 9.

Figure 9:
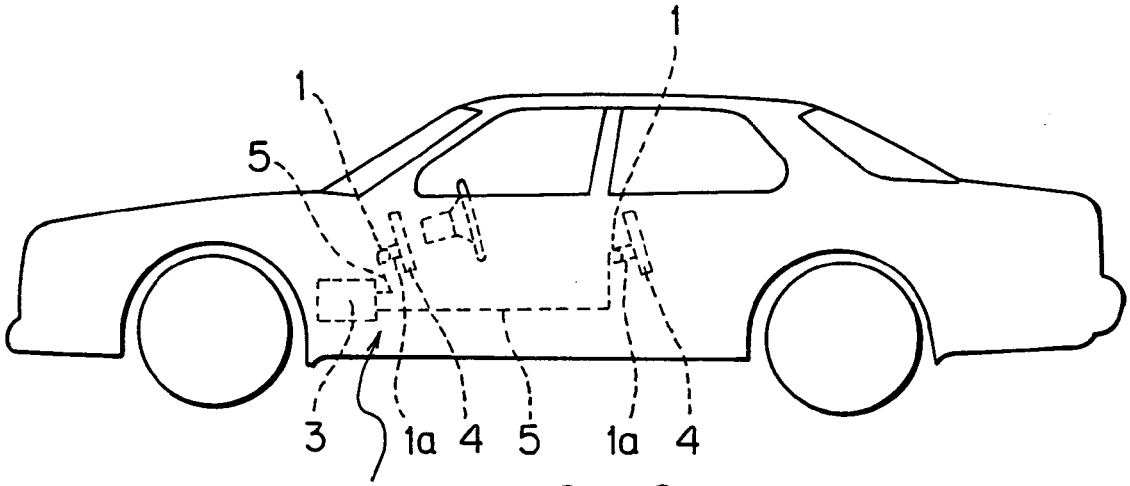
FIG. 9 is an illustration for showing places on a vehicle in which the connector and the mating connector shown in FIG. 1 are mounted, for example of use of the connectors.

The navigation system 2 has the main body 3 for calculating a present position, and the display device 4 for showing the present position and a target position, as shown in FIG. 9. The main body 3 may be mounted in a dashboard of the vehicle. The display devices 4 are placed respectively at front seat area and at rear seat area in the vehicle as shown in FIG. 9. The display devices 4 are required to have high resolution and capability of showing the present position at real time. Therefore, required signals (electric currents) are transmitted from the main body 3 to the display devices 4 through a high-speed differential transmission method.

In the high-speed differential transmission method by using two signal lines (positive and negative lines), High and Low signals are detected with a deference of voltage values of the two signal lines. One signal of two signals in the high-speed differential transmission method is named a positive signal and the other signal is named a negative signal hereafter. The two signals have the same voltage value with different phase angles shifted 180 degrees to each other. Thereby, the positive signal in the specification may have a negative voltage value and the negative signal may have a positive voltage value. The high-speed differential transmission method can cancel noise generated in the two signal lines when inputting the signals into a receiver. Thereby, the high-speed differential transmission method can transmit signals at high speed.

Figure 3:
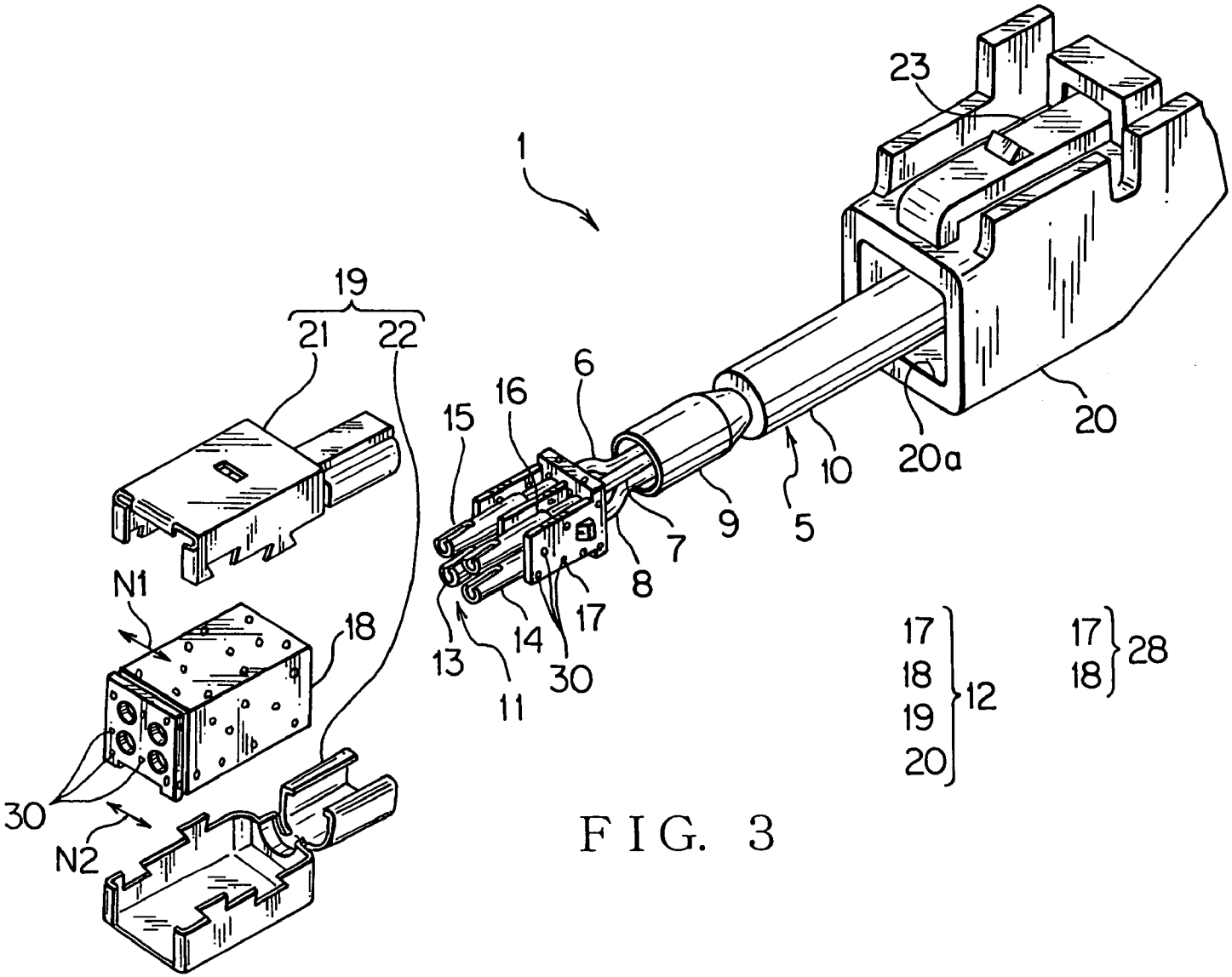
FIG. 3 is an exploded perspective view of the connector shown in FIG. 2.

The main body 3 is connected with the display devices 4 by cables 5 for high-speed differential transmission, the connector 1 joined to an end of the cable 5, and the connector 1*a*, mounted on a printed circuit board 41 of the display device 4, to be connected with the connector 1. The connector 1, and the mating connector 1*a* should be for high-speed differential transmission. The cable 5 includes a positive-signal wire 6 for transmitting positive signals, a negative-signal wire 7 for transmitting negative signals, a ground wire 8, an aluminum-laminated sheath 9, and an insulating tube 10, as shown in FIG. 3.

The positive-signal wire 6, the negative-signal wire 7, and the ground wire 8 are usual covered electrical wires having a conductive core wire and a cover for covering the core wire. The positive-signal wire 6 and the negative-signal wire 7 are connected with the main body 3 for transmitting signals (electric current) supplied from the main body 3 to the display device 4. The positive-signal wire 6 and the negative-signal wire 7 transmit the signals (electric currents) of the same voltage value with different phase angles shifted 180 degrees to each other.

The ground wire 8 is connected with a not-shown earth ground for leading electric noise, which is generated by electric current flowing through the positive-signal wire 6 and the negative-signal wire 7, to the earth ground. The wires 6, 7, and 8 correspond to the electrical wires in the specification.

The aluminum-laminated sheath 9 is made of an aluminum alloy and formed into thin film. The aluminum-laminated sheath 9 covers the wires 6, 7, and 8. The aluminum-laminated sheath 9 is connected with a not-shown earth ground for leading electric noise, which comes from an outside into the wires 6, 7, 8, to the earth ground. The insulating tube 10 is made of an insulating synthetic resin, and covers the aluminum-laminated sheath 9.

Figure 2:
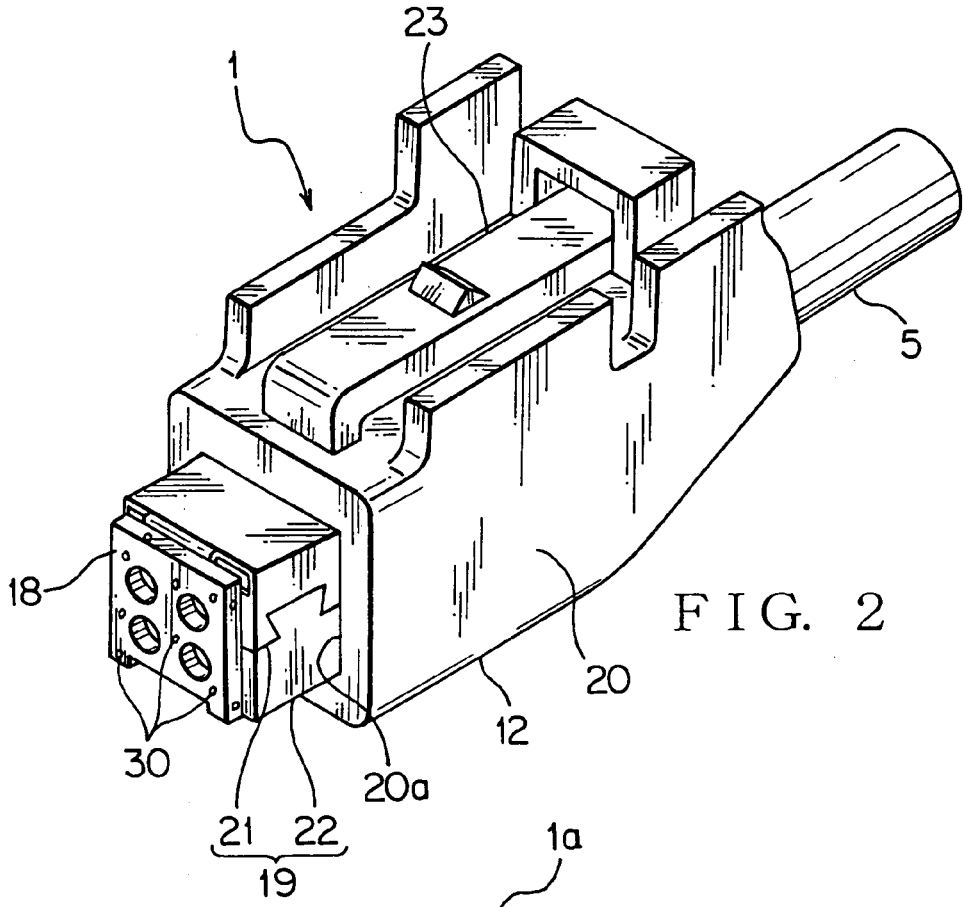
FIG. 2 is a perspective view of the connector shown in FIG. 1.
Figure 5:
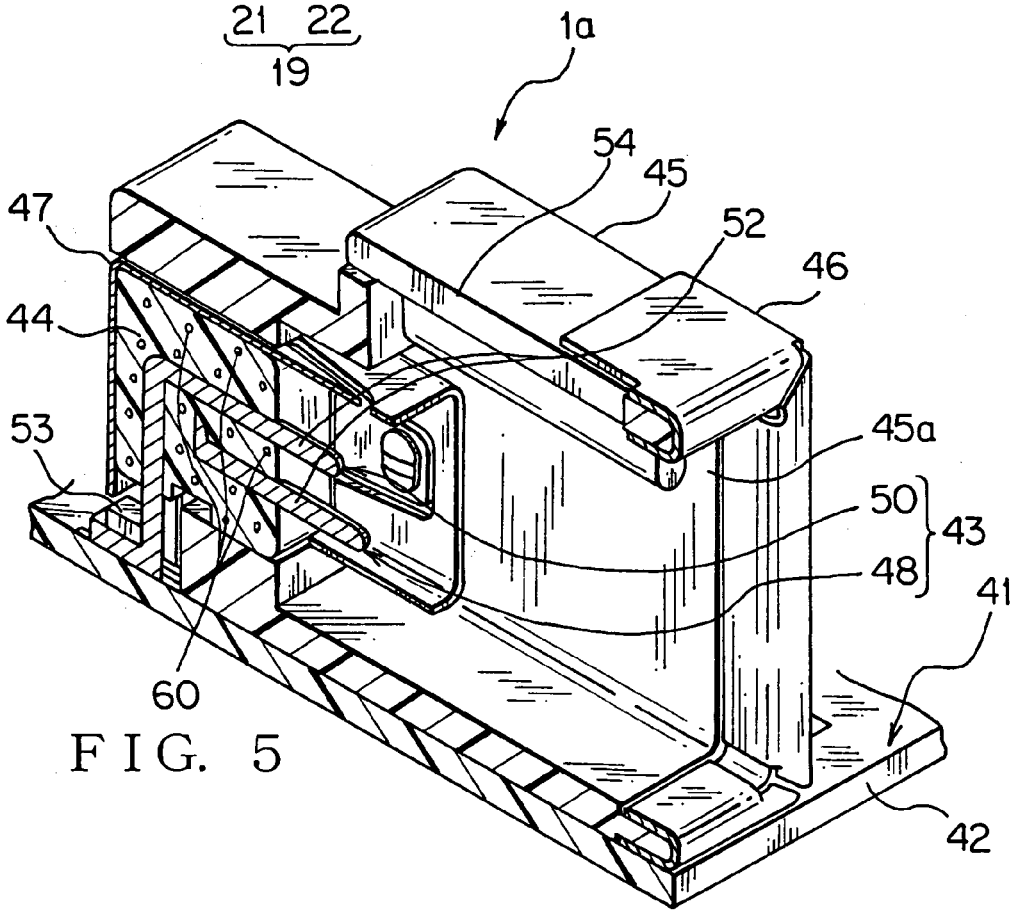
FIG. 5 is a perspective view of the mating connector shown in FIG. 4.

The connector 1 is joined with an end of the cable 5 as shown in FIG. 2, and connected with the connector 1*a* mounted on the printed circuit board 41 of the display device 4. The connector 1 includes a terminal set 11, and a connector housing 12.

The terminal set 11 has a positive-signal terminal 13, a negative-signal terminal 14, a first ground terminal 15, and a second terminal 16, as shown in FIG. 3. The each terminals 13, 14, 15, 16 is made of a conductive metal, and formed in a tubular-shape.

The positive-signal terminal 13 is connected electrically with the positive-signal wire 6 of the cable 5. The negative-signal terminal 14 is connected electrically with the negative-signal wire 7 of the cable 5. The positive-signal terminal 13 and the negative-signal terminal 14 transmit the signals (electric currents) of the same voltage value with different phase angles shifted 180 degrees to each other, supplied from the main body 3 to the display devices 4.

The first ground terminal 15 corresponds to the positive-signal terminal 13, and is connected with the ground wire 8. The first ground terminal 15 leads electric noise generated by transmitting the signals (electric current) in the positive-signal terminal 13 through the ground wire 8 to the earth ground.

The second ground terminal 16 is a separated part from the first ground terminal 15, and corresponds to the negative-signal terminal 14, and is connected with the ground wire 8. The second ground terminal 16 leads electric noise generated by transmitting the signals (electric current) in the negative-signal terminal 14 through the ground wire 8 to the earth ground.

Figure 8:
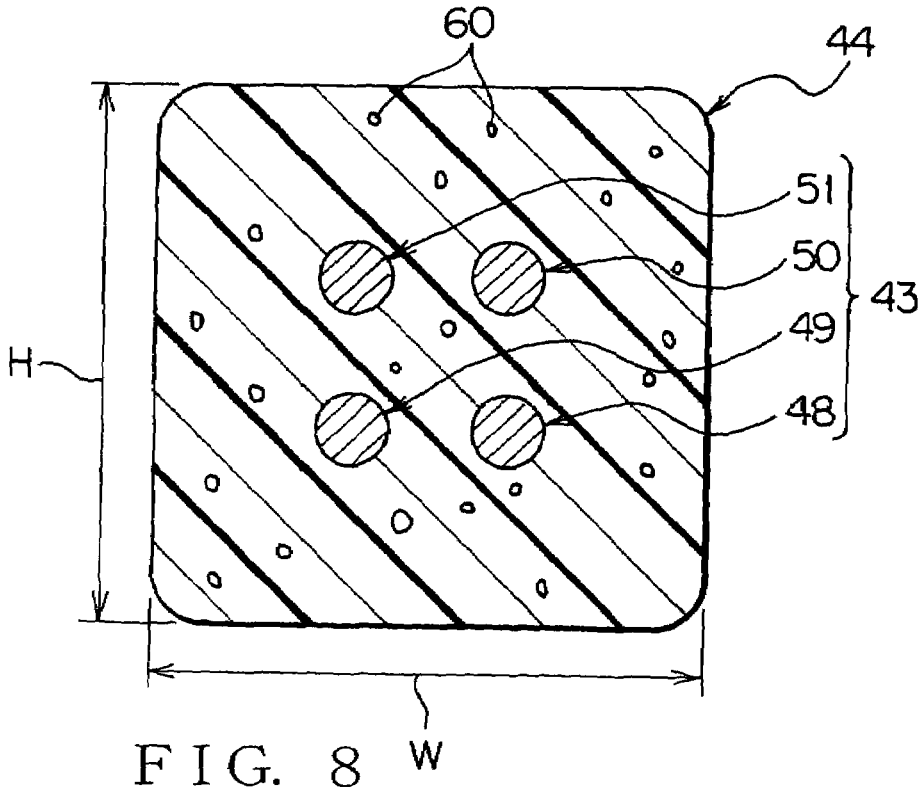
FIG. 8 is a sectional view taking along the line VIII—VIII in FIG. 7.

In the terminal set 11 structured above, the terminals 13, 14, 15, 16 are located at apexes of a quadrangle when viewed from a connector housing 12 side of the display device 4, that is, a side facing to a later-described opening 20*a* of the connector housing 12, as shown in FIG. 8. In the embodiment, the terminals 13, 14, 15, 16 form a quadrangle shape as shown in FIG. 8.

The positive-signal terminal 13 and the negative-signal terminal 14 are located in parallel to each other along an arrow N1 in FIG. 3. The first ground terminal 15 and the second ground terminal 16 are located in parallel to each other along an arrow N2 in FIG. 3. The arrows N1, N2 are in parallel to each other.

Thereby, a distance between the first ground terminal 15 and the positive-signal terminal 13 is shorter than that between the first ground terminal 15 and the negative-signal terminal 14 in the terminal set 11. In other words, the first ground terminal 15 is located nearer to the positive-signal terminal 13 than the negative-signal terminal 14.

Furthermore, a distance between the second ground terminal 16 and the negative-signal terminal 14 is shorter than that between the second ground terminal 16 and the positive-signal terminal 13 in the terminal set 11. In other words, the second ground terminal 16 is located nearer to the negative-signal terminal 14 than the positive-signal terminal 13.

The connector housing 12 receives the terminals 13, 14, 15, 16. The connector housing 12 includes a holder 28 having an inner holder 17 and an inner housing 18, a conductive case 19, and an outer housing 20, as shown in FIG. 3.

The inner holder 17 is made of a foamed insulating synthetic resin. The inner holder 17 has a lot of bubbles 30 inside thereof. The inner holder 17 holds the terminals 13, 14, 15, 16 located as described above. The inner housing 18 is made of the formed insulating synthetic resin, and is formed into a rectangular box-shape. Thereby, the inner housing 18 has numerous bubbles 30 inside thereof. The inner housing 18 receives the inner holder 17, and the terminals 13, 14, 15, 16 held in the inner holder 17. The inner holder 17 and the inner housing 18 structures the holder 28 for holding the terminals 13, 14, 15, 16.

The synthetic resin of the inner holder 17 and the inner housing 18, and an expansion ratio thereof are determined so as to match an impedance of an assembly of the inner holder 17, the inner housing 18 and the terminals 13, 14, 15, 16 with an impedance of the cables 5. By changing the synthetic resin and the expansion ratio thereof, dielectric constant of an assembly of the inner holder 17 and the inner housing 18 is changed.

Each sectional area of the terminals 13, 14, 15, 16 is determined to each have required mechanical strength. The impedance of an assembly of the inner holder 17, the inner housing 18, and the terminals 13, 14, 15, 16 is determined by the distances between the terminals 13, 14, 15, 16, the sectional areas of the terminals 13, .14, 15, 16, and the dielectric constant of the assembly of the inner holder 17 and the inner housing 18.

The expansion ratio of the foamed synthetic resin corresponding to the dielectric constant of the assembly of the inner holder 17 and the inner housing 18 is determined so as to have impedance matching between the wires 6, 7, 8, and the assembly of the inner holder 17, the inner housing 18 and the terminals 13, 14, 15, 16. In this embodiment, the distances between the terminals 13, 14, 15, 16 and the sectional areas of the terminals 13, 14, 15, 16 are determined as mentioned above, so that the impedance is adjusted by changing the expansion ratio, that is, dielectric constants of the inner holder 17 and the inner housing 18.

The conductive case 19 includes a first case 21 and a second case 22 to be coupled with each other. The cases 21, 22 are made of a conductive sheet metal. The cases 21, 22 are coupled with each other to cover the inner housing 18. The cases 21, 22, that is, the conductive case 19, is connected with the aluminum-laminated sheath 9 of the cable 5.

The outer housing 20 is made of an insulating synthetic resin, and formed into a rectangular pipe shape. The outer housing 20 receives the inner holder 17, the terminals 13, 14, 15, 16 held in the inner holder 17, the inner housing 18, and the conductive case 19 covering the inner housing 18. The outer housing 20 is provided at a front side in FIG. 3 with an opening as the opening 20*a* of the connector housing 12, mentioned above. The outer housing 20 has a lock arm 23 to engage with the connector 1*a* mounted on the printed circuit board 41 of the display device 4.

The connector 1 is constructed by the steps as following. Firstly, a target impedance of the assembly of the holder 28 having the inner holder 17 and the inner housing 18, and the terminals 13, 14, 15, 16 is determined according to the impedance of the cable 5. The distances between the terminals 13, 14, 15, 16 are determined correspondingly to the location of each wires 6, 7, 8 of the cable 5. The sectional areas of the terminals 13, 14, 15, 16 are determined by the required mechanical strength. Thereby, a size of the inner holder 17 and the inner housing 18 is determined. Then, the target dielectric constant of the inner holder 17, and the inner housing 18 is specified.

Thereafter, the synthetic resign of the inner holder 17 and the inner housing 18 is determined. The expansion ratio of the synthetic resin is calculated to meet the target dielectric constant. Then, mixing an amount of the foaming agent into the synthetic resin for having the calculated expansion ratio, the inner holder 17 and the inner housing 18 is formed by foam molding. Thus, the dielectric constant of the holder 28 having the inner holder 17 and the inner housing 18 is adjusted by changing the expansion ratio for impedance matching.

The foam molding mentioned above is performed by the steps of mixing a foaming agent in the synthetic resin for the holder 28, agitating them, and heating the synthetic resign to be melted. The foaming agent is decomposed or vaporized by heat to melt the synthetic resin so as to generate bubbles in the synthetic resin. By injecting the foamed synthetic resin into a die, the holder is molded. The foam molding in the specification is molding with a foamed resin. The holder 28 can be formed by any method of injection molding, compression molding, vacuum forming, and the like.

A decomposition-type foaming agent, which is decomposed by heat, and a vaporization-type foaming agent, which is vaporized by heat, can be used as the foaming agent in the specification. As the decomposition-type foaming agent, ammonium carbonate, sodium acid carbonate, an azo compound, a nitroso compound, an azido compound, and the like can be used. As the vaporization-type foaming agent, sodium carbonate, and the like can be used.

As the synthetic resin for the holder 28, a polyester resin and the like can be used.

After joining the terminals 13, 14, 15, 16 with the wire 6, 7, 8 of the cable 5, the inner holder 17 holds the terminals 13, 14, 15, 16. After inserting the inner holder 17 into the inner housing 18, the inner housing 18 is covered by the cases 21, 22. The inner housing 18 together with the conductive case 19 is inserted into the outer housing 20. Thus, the connector 1 is assembled.

Figure 1:
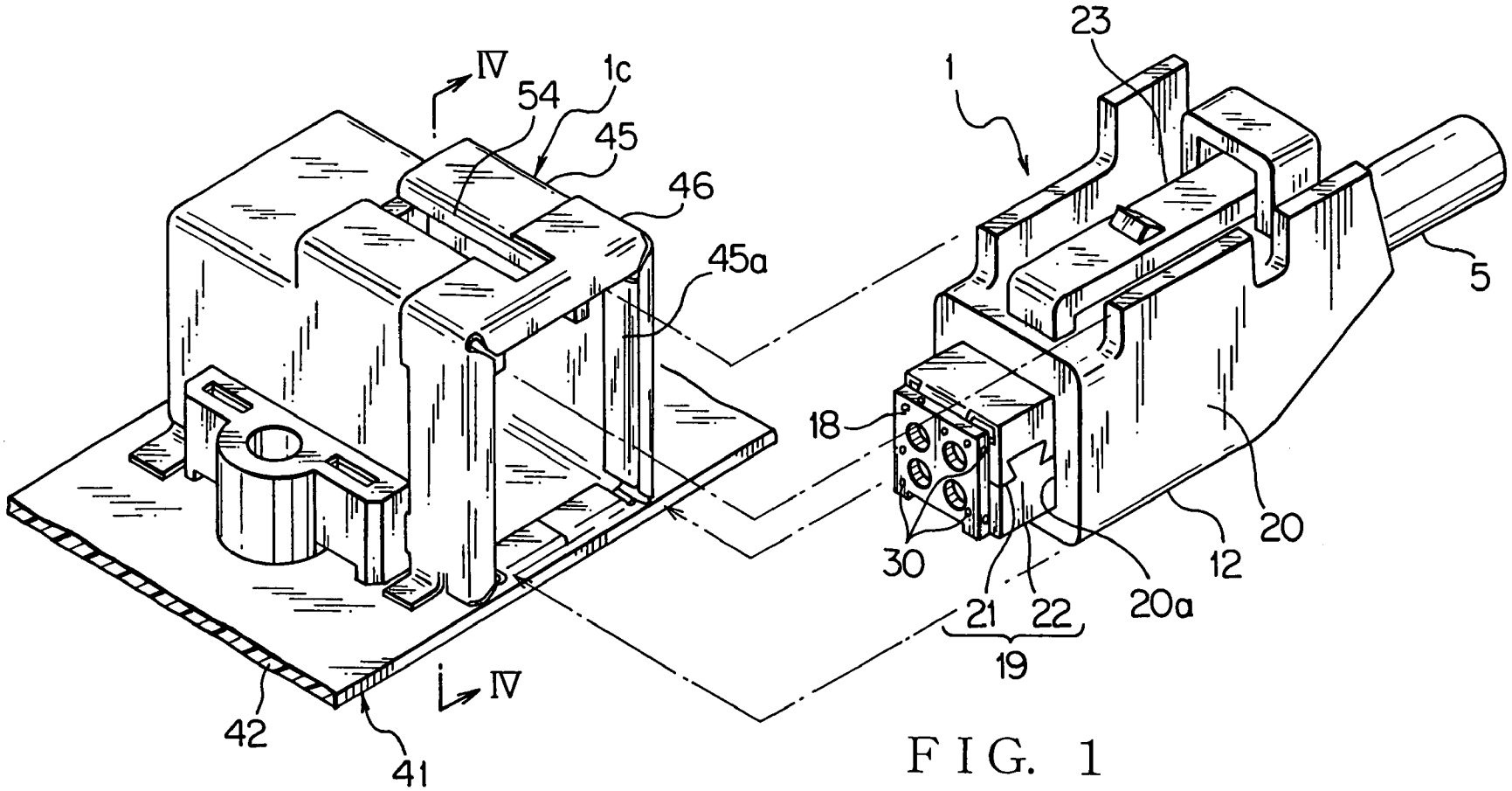
FIG. 1 is a perspective view of an embodiment of a connector and a mating connector, fitting to each other, according to the present invention.
Figure 4:
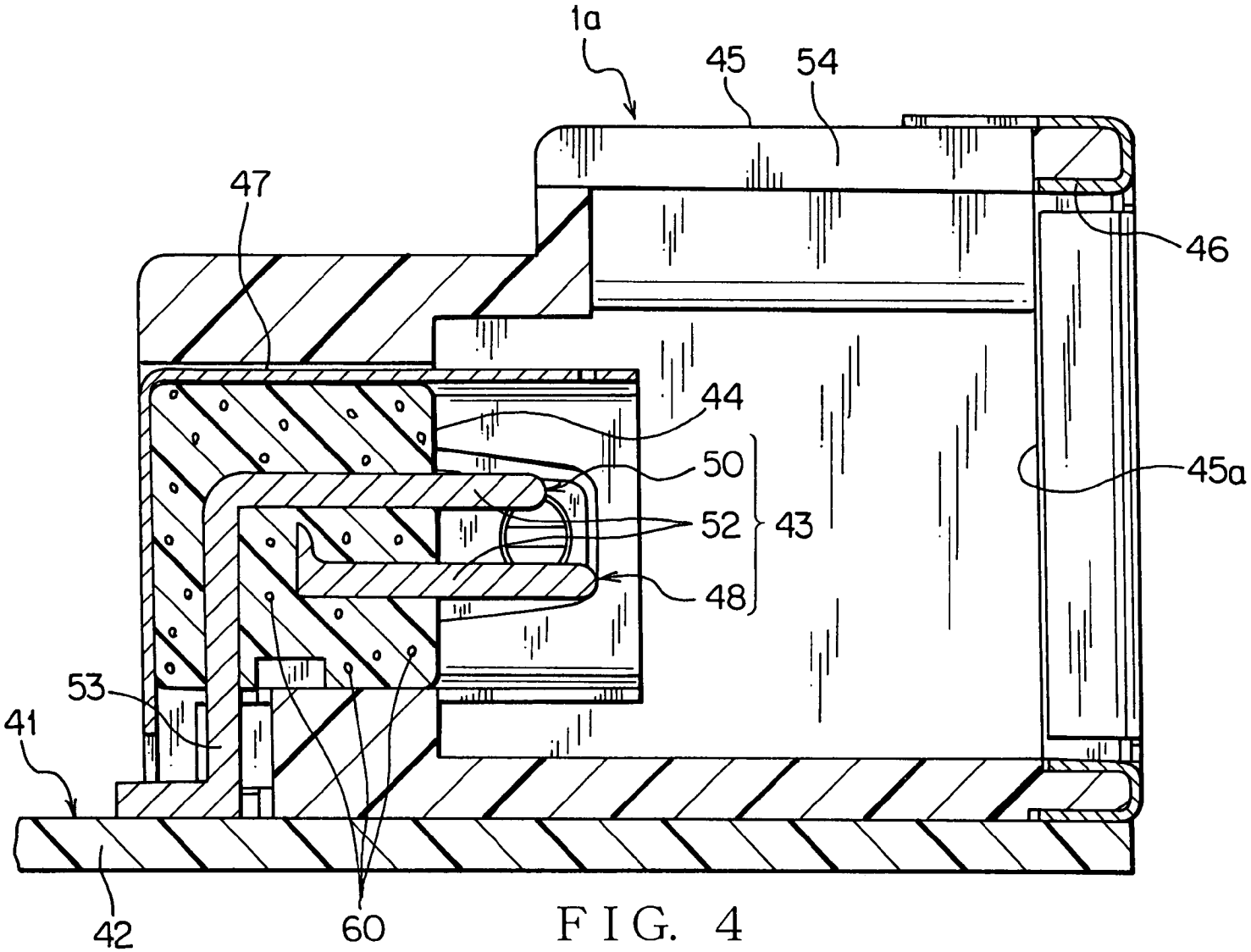
FIG. 4 is a sectional view of the meting connector shown in FIG. 1, taking along the line IV—IV in FIG. 1.

The mating connector 1*a* is mounted on the printed circuit board 41 of the display device 4 as shown in FIG. 1, and connected with the connector 1 joined with the cable 5. The printed circuit board 41 has a base board 42 made of an insulating synthetic resin, and a circuit pattern (not shown) formed on the base board 42, as shown in FIG. 4, 5. The base board 42 is formed into a plate shape. Various electronic components (not shown) are mounted on the base board 42. The circuit pattern is made of a conductive metal, such as copper, and formed as a foil (film) and adhered on a surface of the base board 42. The circuit pattern connects electrically the electronic components on the base board and the display devices 4 through a predetermined pattern (not shown).

The mating connector 1*a* includes a terminal set 43, a holder 44, a connector housing 45, a first conductive case 46, and a second conductive case 47.

Figure 6:
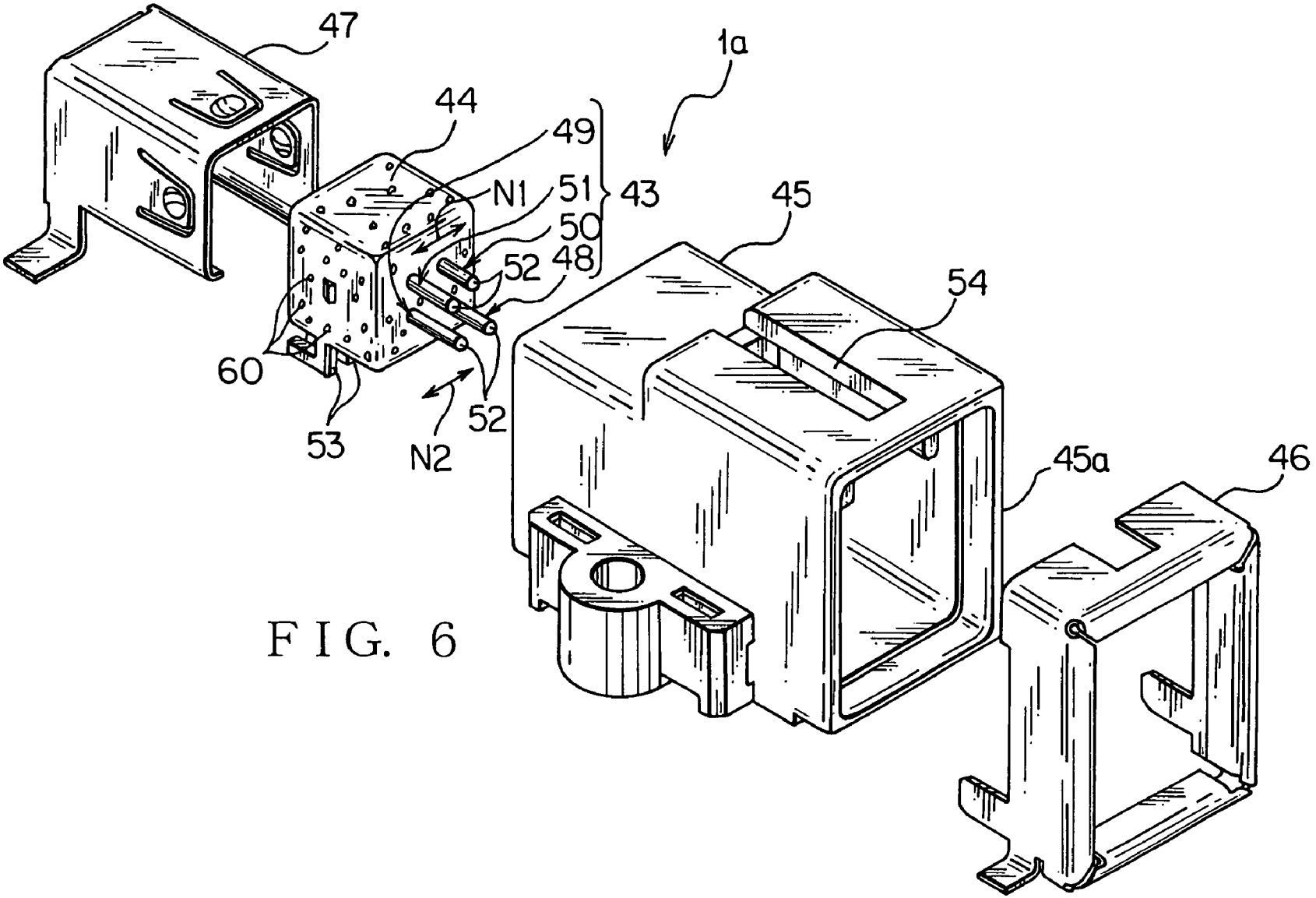
FIG. 6 is an exploded perspective view of the mating connector shown in FIG. 4.

The terminal set 43 has a positive-signal terminal 48, a negative-signal terminal 49, a first ground terminal 50, and a second ground terminal 51, as shown in FIG. 6. The terminals 48, 49, 50, 51 are made of a conductive metal. Each terminal is formed into an L-shape bent round rod.

The positive-signal terminal 48 is connected electrically with the circuit pattern of the printed circuit board 41. When the connectors 1, 1*a* are fitted to each other, the positive-signal terminal 48 is connected with the positive-signal terminal 13 of the connector 1. The negative-signal terminal 49 is connected electrically with the circuit pattern of the printed circuit board 41. When the connectors 1, 1*a* are fitted to each other, the negative-signal terminal 49 is connected with the negative-signal terminal 14 of the connector 1.

The first ground terminal 50 corresponds to the positive-signal terminal 48, and connects electrically with the circuit pattern of the printed circuit board 41. When the connectors 1, 1*a* are fitted to each other, the first ground terminal 50 is connected with the first ground terminal 15 of the connector 1. The first ground terminal 50 leads electrical noise generated by transmitting the signals (electric current) in the positive-signal terminal 48 through the ground wire 8 of the connector 1 to the earth ground.

The second ground terminal 51 is a separated part from the first ground terminal 50, and corresponds to the negative-signal terminal 49, and is connected with the circuit pattern of the printed circuit board 41. When the connectors 1, 1*a* are fitted to each other, the second ground terminal 51 is connected with the second ground terminal 16 of the connector 1. The second ground terminal 51 leads electrical noise generated by transmitting the signals (electric current) in the negative-signal terminal 49 through the ground wire 8 of the connector 1 to the earth ground.

Each terminal 48, 49, 50, 51 is provided with a first electrical contact 52 to connect electrically with the each connecting terminal, and a second electrical contact 53 to connect electrically with the circuit pattern of the printed circuit board 41, as shown in FIG. 4, 5. The negative-signal terminal 49 and the second ground terminal 51 have the same structure as the positive-signal terminal 48 and the first ground terminal 50 so that the descriptions thereof are omitted.

The first electrical contact 52 is provided at one end of each terminal 48, 49, 50, 51. The second electrical contact 53 is provided at the other end of each terminal 48, 49, 50, 51. The first electrical contact 52 and the second electrical contact 53 are exposed and a middle portion between the first electrical contact 52 and the second electrical contact 53 is located in the holder 44. Thus, the synthetic resin of the holder 44 covers the middle portion.

In the terminal set 43, the terminals 48, 49, 50, 51 are located at apexes of a quadrangle when viewed from the connector 1.

The positive-signal terminal 48 and the negative-signal terminal 49 are located in parallel to each other along an arrow N1 in FIG. 6. The first ground terminal 50 and the second ground terminal 51 are located in parallel to each other along an arrow N2 in FIG. 6. The arrows N1, N2 are in parallel to each other.

Thereby, a distance between the first ground terminal 50 and the positive-signal terminal 48 is shorter than that between the first ground terminal 50 and the negative-signal terminal 49 in the terminal set 43. In other words, the first ground terminal 50 is located nearer to the positive-signal terminal 48 than the negative-signal terminal 49.

Furthermore, a distance between the second ground terminal 51 and the negative-signal terminal 49 is shorter than that between the second ground terminal 51 and the positive-signal terminal 48 in the terminal set 43. In other words, the second ground terminal 51 is located nearer to the negative-signal terminal 49 than the positive-signal terminal 48.

Figure 7:
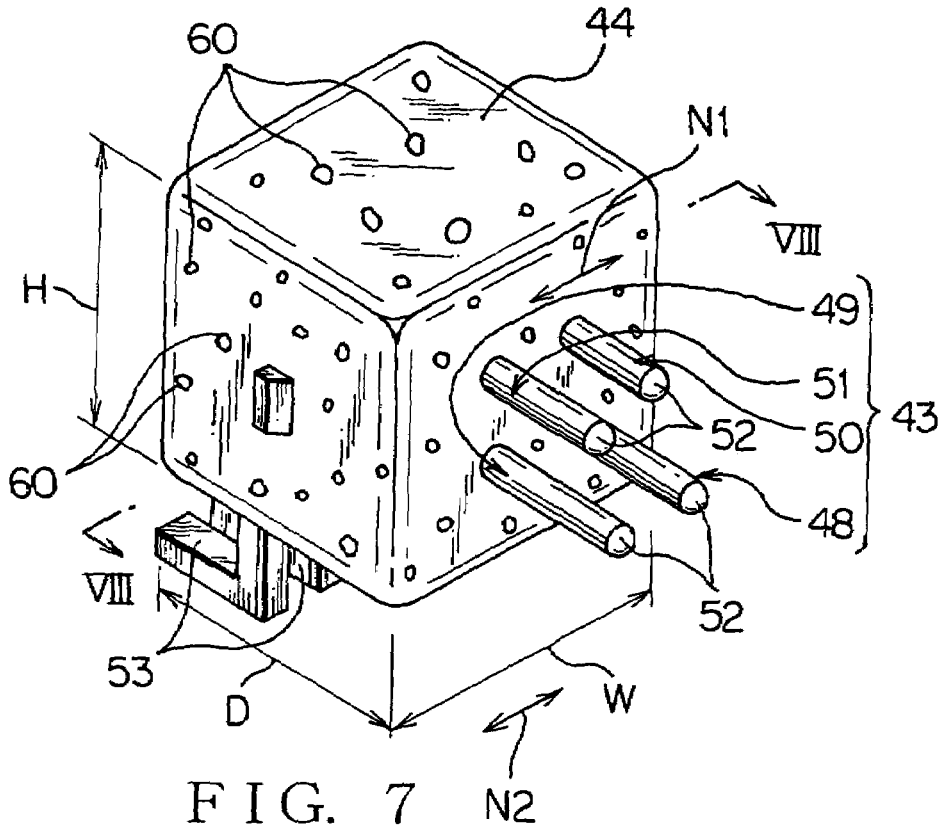
FIG. 7 is a perspective view of a holder molded integrally with each terminals of the mating connector shown in FIG. 6.

The holder 44 is made of a foamed insulating synthetic resin, and is formed into a cubic-like shape. The holder 44 has a lot of bubbles 60 inside thereof as shown in FIG. 7, 8. The holder 44 is received in the connector housing 45. The holder 44 holds the terminals 48, 49, 50, 51 by covering the middle portions between the first electric contacts 52 and the second electric contacts of the terminals 48, 49, 50, 51. The holder 44 is molded integrally with the terminals 48, 49, 50, 51 by insert molding.

The synthetic resin of the holder 44 and the expansion ratio thereof are determined so as to match an impedance of an assembly of the holder 44, and the terminals 48, 49, 50, 51 with an impedance of the connector 1 assembled with the inner holder 17, the inner housing 18, and the terminals 13, 14, 15, 16. In other words, the synthetic resin of the housing 44 and the expansion ratio thereof are determined so as to match the impedance of the assembly of the holder 44, and the terminals 48, 49, 50, 51 with the impedance of the connector 1.

By changing the synthetic resin of the holder 44 and the expansion ratio thereof, dielectric constant of the holder 44 is also changed. The distances between the terminals 48, 49, 50, 51 are determined according to the locations of the terminals 13, 14, 15, 16 of the connector 1.

Each sectional area of the terminals 48, 49, 50, 51 is determined to each have required mechanical strength thereof. The impedance of the assembly of the holder 44, and the terminals 48, 49, 50, 51 is determined by the distances between the terminals 48, 49, 50, 51, the sectional areas of the terminals 48, 49, 50, 51, and the dielectric constant of the holder 44.

The impedance of the holder 44 is determined so as to have impedance matching between the assembly of the holder 44 and terminals 48, 49, 50, 51, and the connector 1. Thus, the dielectric constant of the holder 44 is adjusted by changing the expansion ratio so as to have impedance matching with the connector 1. In this embodiment, the distances between the terminals 48, 49, 50, 51 and the sectional areas of the terminals 48, 49, 50, 51 are determined as mentioned above, so that the impedance is adjusted by changing the expansion ratio, that is, the dielectric constant of the holder 44.

The holders 28, 44 in the specification are made of the synthetic resin by foam molding for holding the terminals 13, 14, 15, 16 and the terminals 48, 49, 50, 51. And the holders 28, 44 are covered by the conductive cases 19 and 47 of conductive material, such as a metal. The holders 28, 44 hold the terminals 13, 14, 15, 16 and the terminals 48, 49, 50, 51 by receiving the terminals in sections (terminal receiving sections) located inside thereof, or molding integrally together with the terminals by insert molding, or engaging the terminals in the holder.

The connector housing 45 receives the holder 44 molded integrally with the terminals 48, 49, 50, 51 by insert molding, as shown in FIG. 4, 5. The connector housing 45 is made of an insulating synthetic resin, and formed into a rectangular pipe shape. The connector housing 45 is provided in the vicinity of an opening 45*a* at a front side thereof in FIG. 1 with a lock groove 54 to engage with the lock arm 23 of the connector 1. The connector housing 45 is fixed on the base board 42 of the printed circuit board 41.

The first conductive case 46 is made of a conductive sheet metal, and formed into a rectangular frame shape. The conductive case 46 covers around the opening 45*a* of the connector housing 45. The second conductive case 47 is made of a conductive sheet metal, and formed into a frame shape. The second conductive case 47 covers the holder 44 and is received in the connector housing 45. The conductive cases 46, 47 are joined electrically with the circuit pattern of the printed circuit board 41 to be connected with the earth ground through the circuit pattern.

The mating connector 1*a* is constructed by the steps as follows. Firstly, a target impedance of the assembly of the holder 44, and the terminals 48, 49, 50, 51 is determined according to the impedance of the connector 1. The distances between the terminals 48, 49, 50, 51 are determined correspondingly to the location of the terminals 13, 14, 15, 16 of the connector 1. The sectional areas of the terminals 48, 49, 50, 51 are determined by the required mechanical strength. Thereby, a size (height H, width W, depth D in FIG. 7) of the holder 44 is determined. Then, the target dielectric constant of the holder 44 is specified to have impedance matching with the connector 1.

Thereafter, the synthetic resign of the holder 44 is determined. The expansion ratio of the synthetic resin is calculated to meet the target dielectric constant. Then, mixing the amount of the foaming agent into the synthetic resin for having the calculated expansion ratio, the holder 44 is formed by foam molding to hold the middle portions of the terminals 48, 49, 50, 51. Thus, the dielectric constant of the holder 44 is adjusted by changing the expansion ratio for impedance matching.

The holder 44 is covered by the second conductive case 47 and inserted into connector housing 45. The first conductive case 46 covers around the opening 45*a* of the connector housing 45. Thus, the connector 1*a* is assembled. The connector 1*a* is mounted on the printed circuit board 41 of the display device 4. Thereby, the second electric contacts 53 of the terminals 48, 49, 50, 51, and the conductive cases 46, 47 are connected electrically with the circuit pattern.

Engaging the lock arm 23 with the lock groove 54, the connectors 1, 1*a* are fitted together. Thus, the connectors 1, la connect the main body 3 and the display device 4 of the navigation system 2.

The first ground terminals 15, 50 are provided correspondingly to the positive-signal terminals 13, 48. And, the second ground terminals 16, 51 are provided correspondingly to the negative-signal terminals 14, 49. Thereby, when signals (electric current) are transmitted through the positive-signal terminals 13, 48, induced electric current is generated in the first ground terminals 15, 50. And, when signals (electric current) are transmitted through the negative-signal terminals 14, 49, induced electric current is generated in the second ground terminals 16, 51. The first ground terminals 15, 50 are separated from the second ground terminals 16, 51.

Thereby, when current flows through the positive-signal terminals 13, 48, and the induced electric current flows through the first ground terminals 15, 50, it is prevented that induced electric current is generated in the negative-signal terminals 14, 49, and the second ground terminals 16, 51. And, when current flows through the negative-signal terminals 14, 49, and the induced electric current flows through the second ground terminals 16, 51, it is prevented that induced electric current is generated in the positive-signal terminals 13, 48, and the first ground terminals 15, 50. Therefore, it is prevented that electrical noise signals (current) flows in the respective signal terminals 13, 48, 14, 49. Thereby, when transmitting high-speed differential signals, transmission loss of signals through the terminals 13, 48, 14, 49 can be reduced.

The positive-signal terminals 13, 48, the negative-signal terminals 14, 49, and the first and second ground terminals 15, 50, 16, 51 are located at the apexes of quadrangles (squares) Thereby, the connector sizes can be miniaturized.

The first ground terminals 15, 50 are located nearer to the positive-signal terminals 13, 48 than the negative-signal terminals 14, 49. The second ground terminals 16, 51 are located nearer to the negative-signal terminals 14, 49 than the positive-signal terminals 13, 48.

Thereby, when current flows through the positive-signal terminals 13, 48, the induced electric current is generated securely in the first ground terminals 15, 50. And, when current flows through the negative-signal terminals 14, 49, the induced electric current is generated securely in the second ground terminals 16, 51. Then, when current flows through the positive-signal terminals 13, 48, and the induced electric current flows through the first ground terminals 15, 50, it is securely prevented that induced electric current is generated in the negative-signal terminals 14, 49, and the second ground terminals 16, 51.

When current flows through the negative-signal terminals 14, 49, and the induced electric current flows through the second ground terminals 16, 51, it is securely prevented that induced electric current is generated in the positive-signal terminals 13, 48, and the first ground terminals 15, 50. Therefore, it is prevented that electrical noise signals (current) flow in the respective signal terminals 13, 48, 14, 49. And, transmission loss of signals through the terminals 13, 48, 14, 49 can be reduced.

The middle portions of the terminals 48, 49, 50, 51 of the connector 1*a* are molded in the holder 44 of synthetic resin. Thereby, the middle portions of the terminals 48, 49, 50, 51 are covered by the synthetic resin of the holder 44 without exposure to an external environment. Therefore, it is prevented that impedance at the middle portion is affected.

The dielectric constants of the holders 44 having the same dimensions, the same synthetic resin, and a different expansion ratio were calculated by simulation based on frequency domain analysis, by the inventors of the present invention. Each impedance of assemblies of the above holders 44 with the different dielectric constants and the terminals 48, 49, 50, 51 was calculated based on frequency domain analysis, by the inventors. Thus, effects of the connectors 1, 1*a* according to the embodiment is confirmed and the result is shown in FIG. 10.

The synthetic resin for the holder 44 is polyester. The foaming agent is sodium carbonate. The holder 44 has the dimensions of the height H 5.8 mm, the width W 5.9 mm and the depth D 5.6 mm. The distances between adjacent terminals 48, 49, 50, 51 are 1.25 mm. The sectional area of the each terminal 48, 49, 50, 51 is 0.385 sq.mm.

Figure 10:
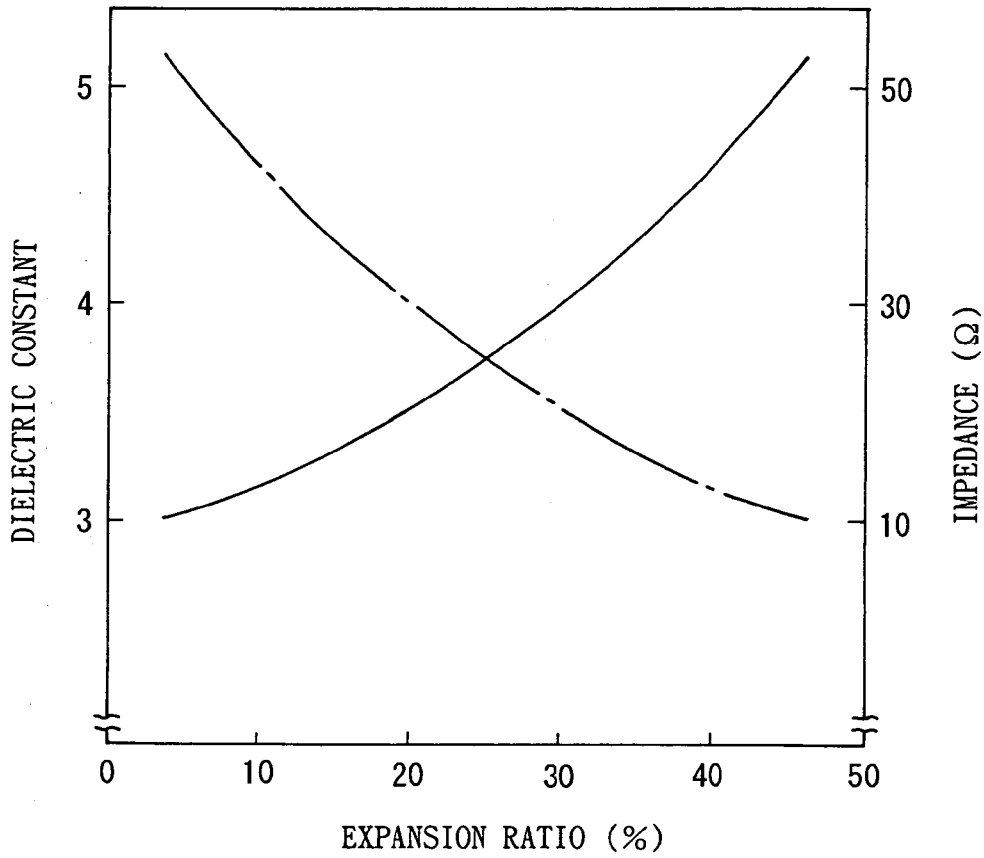
FIG. 10 is a graph for showing effects (impedance and dielectric constant) of the mating connector shown in FIG. 4.

According to change of dielectric constant shown by a long-dashed short-dashed line in FIG. 10, the dielectric constant reduces gradually against increasing the expansion ratio. According to change of the impedance shown by a solid line in FIG. 10, the impedance increases gradually against increasing the expansion ratio. Thus, the dielectric constant can be adjusted (changed) and the impedance of the holder 44 can be adjusted by changing the expansion ratio of the synthetic resin.

The embodiment shows connectors 1, 1*a* having respectively one terminal set 11, 43. The invention can be applied to connectors having respectively a plurality of terminal sets 11, 43.

The invention can be applied to connectors having the terminal sets 11, 43 including the positive-signal terminal 13, 48, the negative-signal terminal 14, 49 and one ground terminal (not shown) corresponding to both positive-signal terminal 13, 48 and negative-signal terminal 14, 49.

The invention can be applied not only to a connector for the high-speed differential type transmission but also to a usual connector for single-end type transmission.

The terminals 13, 48, 14, 49, 15, 50, 16, 51 can have any structure if they are conductive.

It is further understood by those skilled in the art that the foregoing description is a preferred embodiment of the disclosed device and that various changes and modifications may be made in the invention without departing from the spirit and scope thereof.

What is claimed is:

1. A connector, which is connected with a mating connector, comprising:

a plurality of terminals; and a holder holding the plurality of terminals, being made of a foamed synthetic resin, wherein a dielectric constant of the foamed synthetic resin of the holder is adjusted by changing an expansion ratio of the foamed synthetic resin so as to have impedance matching between said connector and each one of electrical wires connected with the plurality of terminals and the mating connector; and the impedance of an assembly of the holder and the terminals is determined by distances between the terminals, sectional areas of the terminals, and the dielectric constant of the holder.

2. A method of manufacturing a connector, which has a plurality of terminals and a holder holding the plurality of terminals, and is connected with a mating connector, the method comprising the steps of:

(1)controlling an expansion ratio of a foamed synthetic resin by changing an amount of a foaming agent to be mixed in the synthetic resin so as to adjust a dielectric constant of the synthetic resin for having impedance matching between the connector, and each one of electrical wires connected with the plurality of terminals and the mating connector;

(2) determining distances between the terminals to correspond to the location of a negative-signal wire of a cable, a positive-signal wire of a cable;

(3) determining sectional areas of the terminals in relation to a required mechanical strength;

(4) determining a size of the holder according to the distances determined in step (2), and the sectional areas determined in step (3); and forming the holder with the foamed synthetic resin.

3. A method as claimed in claim 2, further comprising the following steps:

(6) forming an inner housing with the foamed synthetic resin; and, (7) joining the terminals with a cable, at least one terminal as a positive-signal terminal with a positive-signal wire, at least one terminal as a negative-signal terminal with a negative-signal wire, and at least two terminals as ground terminals with a ground wire; positioning the terminals in the holder; inserting the holder into the inner housing; covering the inner housing with a conductive case; inserting the conductive case in an outer housing.

4. A connector, which is connected with a mating connector, comprising:

a plurality of terminals;

an inner holder;

an inner housing;

a conductive case; and, an outer housing;

the terminals being made of conductive metal; at least one terminal, as a positive-signal terminal, being connected electrically to a positive-signal wire of a cable; at least one terminal, as a negative-signal terminal, being connected electrically to a negative-signal wire of a cable;

the inner holder being inserted into the inner housing; the inner housing and the inner holder being formed with foamed synthetic resin;

the conductive case having a first case and a second case to be coupled with each other; the cases being formed with conductive metal; the cases being coupled with each other to cover the inner housing, and the inner holder and terminals being positioned therein;

the conductive case being inserted into the outer housing; the outer housing being formed with synthetic resin; the outer housing having a lock arm to engage with a mating connector;

wherein a dielectric constant of an assembly of the foamed synthetic resin inner holder and the foamed synthetic resin inner housing is adjusted by changing an expansion ratio of the foamed synthetic resin so as to have impedance matching between the connector and each one of the electrical wires connected with the plurality of terminals and the mating connector; and the impedance of an assembly of the inner holder, the inner housing, and the terminals is determined by distances between the terminals, sectional areas of the terminals, and the dielectric constant of the inner holder and the inner housing.

* * * * *